US005655556A

United States Patent [19]

Guerrera et al.

[11] Patent Number: 5,655,556

[45] Date of Patent: Aug. 12, 1997

[54] DISHWASHER WITH ROTATING SPRAY AGITATOR

[75] Inventors: Carlo Guerrera, Pordenone; Franco Marcorin, Venezia; Dino Munini, Pordenone, all of Italy

[73] Assignee: Electrolux Zanussi Elettrodomestici S.p.A., Pordenone, Italy

[21] Appl. No.: 490,166

[22] Filed: Jun. 14, 1995

[30] Foreign Application Priority Data

Jun. 16, 1994 [IT] Italy ..... PN940023 U

[51] Int. Cl.[6] ..... B08B 3/02

[52] U.S. Cl. ..... 134/176; 134/179; 134/198; 134/201; 239/256; 239/258

[58] Field of Search ..... 134/176, 179, 134/183, 158, 201, 56 D, 57 D, 58 D; 239/265.19, 255, 258, 256, 222.17, 251

[56] References Cited

U.S. PATENT DOCUMENTS

| | | | |
|---|---|---|---|
| 1,408,077 | 2/1922 | Clinton | 134/179 |
| 1,733,249 | 10/1929 | Clinton | 239/255 |
| 2,021,710 | 11/1935 | Wilson . | |
| 2,202,349 | 5/1940 | Lewis | 239/258 |
| 3,160,164 | 12/1964 | Constance et al. | 239/256 |
| 3,596,834 | 8/1971 | Cushing | 239/255 |
| 3,642,208 | 2/1972 | Guth | 239/255 |
| 3,771,725 | 11/1973 | Jenkins et al. | 134/179 |
| 3,797,509 | 3/1974 | Fukuzawa et al. . | |
| 4,884,585 | 12/1989 | Oh | 239/255 |

FOREIGN PATENT DOCUMENTS

| | | |
|---|---|---|
| 0053231 | 6/1982 | European Pat. Off. . |
| 4020899 | 1/1992 | Germany . |

*Primary Examiner*—Frankie L. Stinson

*Attorney, Agent, or Firm*—Pearne, Gordon, McCoy & Granger LLP

[57] ABSTRACT

A dishwasher with a spray agitator (1) rotating about an axis (2) in alternating opposite directions due to the effect of two nozzles with opposite thrusts (6,7). The nozzles are alternately fed with water under pressure by means of a rotating shutter (13). The shutter is made to rotate by reduction gears (12,14) and a rotor (11) activated by a nozzle (8) provided inside the agitator (1). The dishes are washed efficiently even if a mechanical obstruction interferes with the agitator.

5 Claims, 2 Drawing Sheets

DISHWASHER WITH ROTATING SPRAY AGITATOR

BACKGROUND OF THE INVENTION

The present invention concerns a dishwasher, in particular of the domestic type, provided with at least one improved agitator to spray dishes supported in a suitable basket.

As is known, agitators of a dishwasher rotate due to the effect of reactions caused by water jets coming out of respective pressure nozzles. The pressure nozzles are normally fixed so as to emerge from the agitator, which then rotates in a predetermined direction. Obviously, the agitators also include nozzles that spray dishes, which can be fixed and/or rotating. In any case, the spray nozzles do not substantially effect the rotation of the agitator.

In some cases dishes, incorrectly positioned in the dishwasher, interfere with and block the agitator. This compromises the results of washing and the machine may be insufficiently cooled because of the thermal resistance of the water. To eliminate these inconveniences, dishwashers have been proposed in which there is an electromagnetic sensor capable of activating an alarm device if an agitator rotates below a predetermined speed, as described for example in EP 0,053,231.

A similar mechanical solution is described, for example, in DE 4,020,899, in which a valve device and a blocking device are capable of reducing the rotation of the agitator, permitting the washing program to proceed only if the agitator itself is not interfered with by the dishes during an initial "exploratory" rotation. If there is interference the functioning of the dishwasher is interrupted or an alarm device is activated.

Such solutions are unduly complicated and costly, and in any case they do not solve the functional problems arising from a possible blockage of the agitator. They are limited to signaling the blockage, so that the user can intervene appropriately to restore a condition of proper functioning.

A more effective solution that operates automatically is described in U.S. Pat. No. 3,797,509, in which the direction of rotation of the agitator in a dishwasher can be reversed by means of using a spherical bi-stable commutation valve that selectively feeds opposing pressure nozzles provided on the agitator. The alternating commutations of the spherical valve are controlled according to a preset program by means of suitable pauses in the functioning of the pump that feeds the agitator. Therefore, repeated reversals of the direction of rotation of the agitator require corresponding pauses of the pump and the corresponding drag motor, as well as a suitable programming system for the machine. As a result, the hydraulic noise caused by the intermittent functioning of the pump is unduly high. The drag motor is subject to repeated demands, which reduce its lifetime, and programming of the machine requires a relatively complex system. In any case, the spherical commutation valve has a critical function, being subject to sticking caused by contact with particles of dirt suspended in the water. The valve also unduly increases the vertical space needed by the agitator.

SUMMARY OF THE INVENTION

The purpose of the present invention is to provide a simple dishwasher with at least one rotating spray agitator capable of performing an efficient washing of dishes even when they interfere incorrectly with the agitator itself. The invention uses particularly effective, reliable, and compact means to control the rotation of the agitator. Another purpose of the invention is to provide a dishwasher of the type mentioned, in which correct functioning of the rotating agitator is not substantially influenced by dirt particles suspended in the water that feeds the agitator itself. According to the invention, these purposes are achieved in a dishwasher with a rotating spray agitator incorporating the characteristics of the attached claims.

BRIEF DESCRIPTION OF THE DRAWINGS

The characteristics and advantages of the invention will be clarified by the following description, which is given only as a non-limiting example, with reference to the diagrams included, in which.

DETAILED DESCRIPTION OF THE PREFERRED EMBODIMENTS

Figure 1:
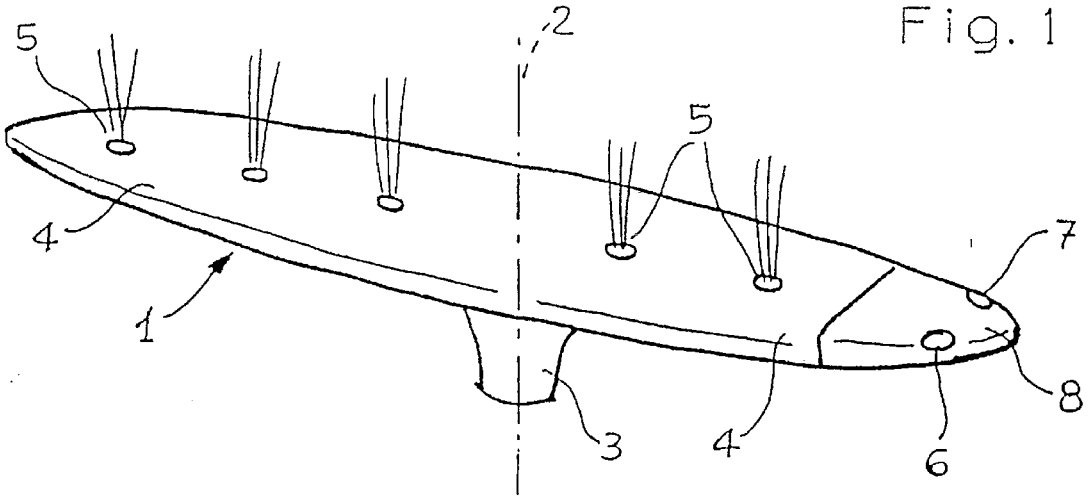
FIG. 1 shows schematically in perspective a rotating spray agitator of a dishwasher according to the invention.

With reference to FIG. 1, a dishwasher includes a wash basin in which, in a substantially traditional manner, at least one hollow agitator 1 is located. The agitator is adapted for rotating about a substantially vertical axis 2 in order to spray water on dishes placed in an associated adjacent basket (not shown).

The agitator 1 can be fed with water under pressure (provided by a circulating pump, not shown) through a central supply conduit 3. The agitator is preferably of the type with two opposing radial arms 4, but the agitator 1 can comprise one or more radial arms 4, as required. In any case, the agitator 1 includes several, preferably fixed, nozzles 5, adapted for producing corresponding water jets for washing the dishes.

The rotation of the agitator 1 about its axis 2 occurs because of hydraulic reaction, in a manner that will be described below. In particular, the agitator 1 is provided with a hydraulic pressure device adapted for reversing the direction of rotation of the agitator 1 periodically, in such a way that a possible blockage of the agitator against a mechanical obstacle will only be temporary, until the agitator reverses its own direction of rotation. In such a case, the agitator will perform a series of partial rotations about 18020 in the case of two opposing arms 4 in alternating directions, with the result that the washing jets emitted by the nozzles 5 will still cover an interior angle of rotation that is substantially equal to 360°. In actuality, the result of washing and a homogeneous "bathing" of the heating elements will be substantially sufficient even in the case where a mechanical obstacle interferes with the rotating agitator 1.

The above-mentioned pressure device, capable of reversing the direction of rotation of the agitator 1, includes at least one pair of nozzles 6,7 substantially opposing one another to respectively rotate the agitator in opposite direction. The nozzles are disposed laterally on the agitator 1 in a staggered or offset position with respect to the axis of rotation 2. Preferably, the pressure nozzles 6,7 are each provided so as to correspond to an end 8 of one of the arms 4 of the agitator, and are inclined upwardly so as to contribute also to the washing of the dishes.

Figure 4:
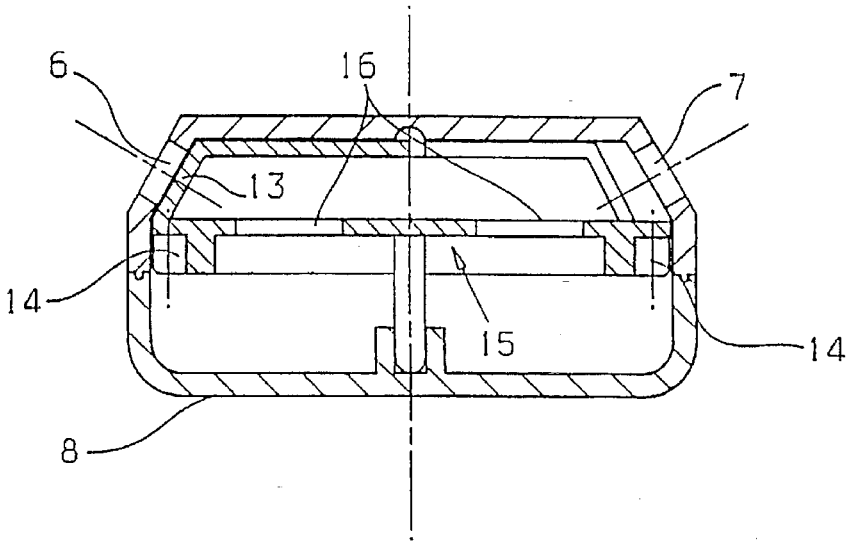
FIG. 4 shows a section along IV—IV of the detail of FIG. 3.
Figure 3:
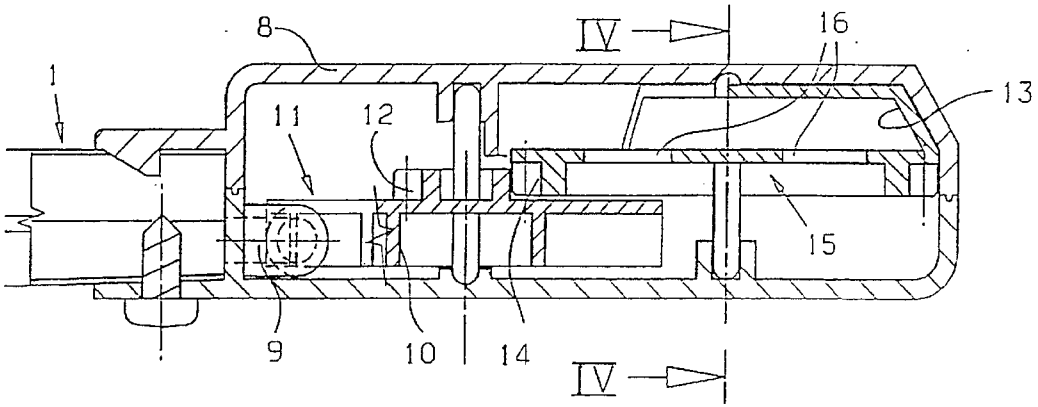
FIG. 3 is a longitudinal section of the detail of FIG. 2.
Figure 2:
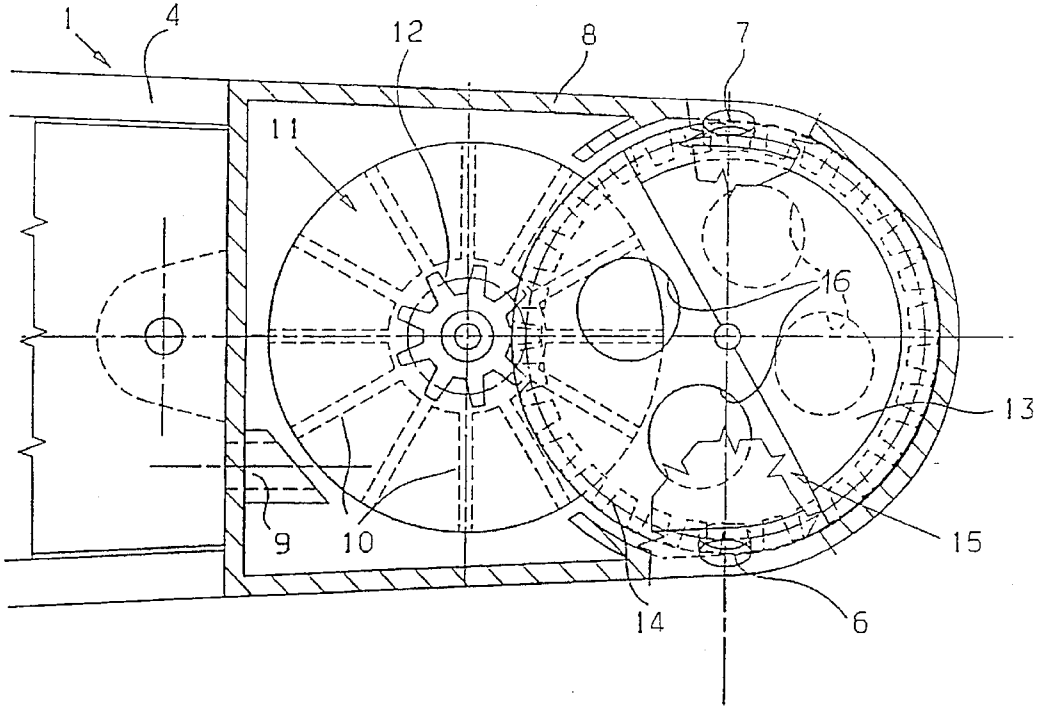
FIG. 2 is a top view, partly in section, of an enlarged detail of the agitator of FIG. 1.

Referring to FIGS. 2 and 3, the end 8 of the agitator has the shape of a box container that communicates with the remaining part of the agitator 1 through at least one activating nozzle 9 or an equivalent hydraulic arrangement adapted for propelling a shutter element 13 into rotation. More precisely, the activating nozzle is capable of producing a water jet that strikes onto several radial blades 10 of a rotor 11 that is journalled freely inside the end 8. The rotor 11 is adapted for propelling the shutter element 3 by means of a transmission having an appropriate reduction ratio. Preferably, the transmission includes at least one gear 12 disposed on the rotor 11. The first gear 12 cooperates with an associated gear 14 disposed on the circumference of a disk-shaped body 15. The gears 12 and 14 are preferably of the type with radial teeth, as shown in FIGS. 2–4, but they can also be of the infinite-screw type, or something similar.

The disk-shaped body 15 is journalled so as to rotate inside the end 8, and rotates fixedly with the shutter 13. an outer surface of the shutter fits in a slipping manner with a corresponding inner surface of the end 8. Therefore, during each rotation of the rotating body 15, the shutter 13 is capable of alternately blocking the pressure nozzles 6,7. The nozzles 6,7 are normally fed by at least one opening 16 in the body 15 with water under pressure that is admitted into the agitator 1. In the example described, the rotating body 15 includes four openings 16 at equal angular distances.

Preferably, the shutter 13 is produced in a substantially semi-circular shape, as shown in FIG. 2, in such a way that during each rotation of the rotation body 15, the pressure nozzles 6,7 alternately emit their respective pressure water jets for complementary periods of time. Obviously, such periods can be varied according to requirements by correspondingly varying the angular extension of the shutter element 13.

The functioning of the dishwasher according to the invention is evident from what has been described. The water under pressure that penetrates into the agitator 1 through the conduit 3 feeds not only the washing nozzles 5, but also the activating nozzle 9. The latter produces a water jet that makes the rotor 11, and thus the shutter 13, rotate. Therefore, the pressure nozzles are fed alternately by water under pressure through the opening 16 in the body 15 to produce corresponding pressure water jets that make the agitator 1 rotate about its own axis 2 in alternating opposite directions. In particular, the alternating reversal of the direction of rotation of the agitator 1 can be obtained advantageously in a periodic mode, with uninterrupted functioning of the circulation pump.

Preferably, the various components will be dimensioned by the field technician in such a way that under normal operating conditions, reversal of the direction of rotation of the agitator 1 occurs after the agitator itself has made a rotation in the opposite direction sufficient to guarantee complete coverage of at least 360° by the washing jets that emerge from the nozzles 5. The rotor 11 carries advantageously opposed gear 12 and blades 10 inside the rotating body 15, by which means dirt particles suspended in the water that feeds the agitator 1 cannot block the various moving mechanical parts to interfere with operation or cause damage.

In addition, it should be noted that, in contrast to the solution noted in the background, the means of reversing the motion imparted to the container 8 does not substantially increase the space occupied by the agitator 1.

Obviously, the dishwasher described can undergo numerous modification within the scope of the invention.

What is claimed is:

1. A dishwasher comprising at least one spray agitator adapted for rotating about a substantially vertical axis; at least one pair of substantially opposed pressure nozzles adapted for being fed alternately with water under pressure to rotate the agitator in opposite directions; and a shutter device through which the pressure nozzles are fed for alternately reversing the direction of rotation of the agitator, characterized by the fact that said dishwasher includes at least one activating nozzle (9) fed by said water under pressure, and a rotating body (15) adapted for being rotated on a complete circular course by water from the activating nozzle the shutter device (13) rotating fixedly with the rotating body (15) and being adapted for blocking the pressure nozzles (6, 7) alternately during each rotation of said rotating body (15) for respective complementary periods.

2. A dishwasher according to claim 1, further comprising a rotor (11) adapted for propelling said rotating body (15) into rotation; several blades (10) disposed on the rotor, said activating nozzle (9) being adapted for producing a water jet that strikes the blades; and a transmission (12,14) having a reduction ratio adapted for transmitting motion from the rotor so as to rotate the rotating body (15).

3. A dishwasher according to claim 2, characterized by the fact that the shutter device, the rotating body (15), the rotor (11), and the activating nozzle (9) are disposed inside the agitator (1).

4. A dishwasher comprising at least one spray agitator adapted for rotating about a substantially vertical axis; at least one pair of substantially opposed pressure nozzles adapted for being fed alternately with water under pressure to rotate the agitator in opposite directions; and a shutter device through which the pressure nozzles are fed for alternately reversing the direction of rotation of the agitator, characterized by the fact that said dishwasher includes at least one activating nozzle (9) fed by said water under pressure; a rotating body (15) adapted for being rotated by water from the activating nozzle the shutter device (13) rotating fixedly with the rotating body (15) and being adapted for blocking the pressure nozzles (6,7) alternately during each rotation of said rotating body (15) for respective complementary periods; a rotor (11) adapted for propelling said rotating body (15) into rotation; several blades (10) disposed on the rotor, said activating nozzle (9) being adapted for producing a water jet that strikes the blades; and a transmission (12,14) having a reduction ratio adapted for transmitting motion from the rotor so as to rotate the rotating body (15).

5. A dishwasher according to claim 4, characterized by the fact that the shutter device, the rotating body (15), the rotor (11), and the acrivating nozzle (9) are disposed inside the agitator (1).

* * * * *